US007798350B2

(12) United States Patent
Hermel et al.

(10) Patent No.: US 7,798,350 B2
(45) Date of Patent: Sep. 21, 2010

(54) CONTAINER WITH AN AT LEAST PARTIALLY TRIANGULAR PRISMATIC BODY

(75) Inventors: Wilfried Hermel, Octeville-sur-Mer (FR); Damien Bourne, Octeville-sur-Mer (FR); Laurent Lepoitevin, Octeville-sur-Mer (FR); Michel Boukobza, Octeville-sur-Mer (FR)

(73) Assignee: Sidel Participations, Octeville Sur Mer (FR)

( * ) Notice: Subject to any disclaimer, the term of this patent is extended or adjusted under 35 U.S.C. 154(b) by 229 days.

(21) Appl. No.: 11/902,256

(22) Filed: Sep. 20, 2007

(65) Prior Publication Data

US 2008/0073315 A1 Mar. 27, 2008

(30) Foreign Application Priority Data

Sep. 22, 2006 (FR) ..... 06 08359

(51) Int. Cl.
*B65D 1/46* (2006.01)
*B65D 1/02* (2006.01)

(52) U.S. Cl. ..... 215/382; 215/381; 220/671; 220/675

(58) Field of Classification Search ..... 215/381–383, 215/379; 220/675, 671, 669
See application file for complete search history.

(56) References Cited

U.S. PATENT DOCUMENTS

| | | | | |
|---|---|---|---|---|
| 3,085,730 | A * | 4/1963 | Fibish | 229/400 |
| 3,702,806 | A * | 11/1972 | Oliva | 435/304.1 |
| 4,372,455 | A * | 2/1983 | Cochran | 215/385 |
| 5,866,419 | A * | 2/1999 | Meder | 435/394 |
| 5,908,128 | A * | 6/1999 | Krishnakumar et al. | 215/381 |
| 6,464,106 | B1 * | 10/2002 | Giblin et al. | 222/109 |
| 6,588,612 | B1 * | 7/2003 | Dorn et al. | 215/10 |
| D489,271 | S * | 5/2004 | Soomar | D9/561 |
| D525,528 | S * | 7/2006 | Lane et al. | D9/516 |
| 7,097,059 | B2 * | 8/2006 | Saito et al. | 215/383 |
| 7,178,684 | B1 * | 2/2007 | Budden et al. | 215/381 |
| D552,477 | S * | 10/2007 | Hermel | D9/538 |
| 2001/0030166 | A1 | 10/2001 | Ozawa et al. | |
| 2004/0011785 | A1 * | 1/2004 | Van Der Heijden et al. | 220/4.13 |

FOREIGN PATENT DOCUMENTS

WO 2005123517 A1 12/2005

* cited by examiner

*Primary Examiner*—Sue A Weaver
(74) *Attorney, Agent, or Firm*—Sughrue Mion, PLLC

(57) ABSTRACT

The invention relates to a container (1') made of a thermoplastic material, especially PET, having a body (2') which, for at least a part of its height, is substantially prismatic in shape with a substantially triangular cross section and with three faces (6) joined by three edges (7), each of which is shaped in the form of a groove (8) which opens outwards and which has a rear wall (9) having a reversed curvature with its convexity being directed outwards.

12 Claims, 4 Drawing Sheets

CONTAINER WITH AN AT LEAST PARTIALLY TRIANGULAR PRISMATIC BODY

FIELD OF THE INVENTION

The present invention relates in general terms to containers made of a thermoplastic material, especially PET, and more specifically to improvements made to containers of this type having a body which, for at least a part of its height, is substantially prismatic in shape with a substantially triangular cross section and with three faces joined by three respective edges.

BACKGROUND OF THE INVENTION

Containers such as bottles provided with a body having such a shape with a substantially triangular cross section and with faces rounded out are already known (see for example documents DE GM 8003050, WO 2005/030590). In these known containers the edges are curved with a relatively small radius of curvature.

For applications that sell in extremely high numbers, such as bottled drink water for example, it is important to reduce the cost of the containers to a minimum, which means using as little material as possible in the manufacture of each container, which in turn means that the walls, of each container must be as thin as possible. Because of their very small radius of curvature, if the edges of the body of a container are deformed for example when the rounded faces of the body are subjected to a radially directed force (as when grasped in the hand), these edges "break", otherwise said they deform in an angular, inelastic manner and are unable to revert to their original form. When deformed in this way, a container loses its stability and, because of its damaged appearance, is no longer saleable.

Admittedly, it is already known from document WO 2005/123517 to adapt the edges by designing them with a projecting form incorporating a rounded portion of the wall flanked by two columns. However, this known arrangement is more particularly designed to prevent the edge deforming when the container is being filled with a hot product. It is not therefore possible for this arrangement to give the edge greater elastic deformability when the rounded faces of the body are subjected to a force acting radially towards the interior. Besides, the resulting bulges between the rounded faces of the body do little for the container's aesthetic qualities.

SUMMARY OF THE INVENTION

It is an object of the invention to provide an improved form for this type of container so that, despite its special shape, it is still able to deform elastically and does not suffer irreversible deformation particularly in the region of its edges.

To this end, the invention provides a container of the above mentioned type which is characterized in that each of the edges is shaped in the form of a groove which opens outwards and which has a rear wall having a reversed curvature with its convexity directed outwards. In a preferred embodiment the apex of the convexity of the rear wall of the groove is substantially level with the edges of the groove.

Because of these features, the edges have a complex configuration that gives them a high deformability: when a force is applied to any of the faces of the body, the edges can pivot, open out and flatten completely elastically in the manner of a hinge, thus avoiding the risk of irreversible deformation. So, when the deforming force is removed, all parts of the container body return elastically to their initial position and configuration.

Since the invention is concerned only with the edges of the substantially prismatic part having a substantially triangular cross section, the arrangements described above can be applied irrespective of the height of the substantially prismatic part, i.e. whether this part occupies the entire height of the container body or only a portion of the height of said body.

In particular, the arrangements of the invention can be applied to a container in which the body is substantially prismatic in shape in its middle part only, which lies between an upper part and a lower part that are both substantially cylinders of revolution and have transverse dimensions appreciably greater than the transverse dimension of said middle part, in such a way that the substantially prismatic middle part of substantially triangular cross section, which is narrower than the parts above and below it, can be held perfectly securely in the hand.

In the context of the application discussed above, it can be advantageously provided that each groove extends as far as the join between the middle and upper parts of the body and that in the region of this join the depth of the groove gradually decreases so that the rear wall of the groove merges approximately into the shape of the upper part. Also, it can be provided that each groove extends as far as the join between the middle and lower parts of the body and that in the region of this join the depth of the groove gradually decreases so that the rear wall of the groove merges approximately into the shape of the lower part; this feature can be completed by providing that each groove extends into the lower part of the body, with the rear wall of the groove merging into the shape of the lower part. Then, in a useful embodiment, it becomes possible, in a container in which the lower part of the body meets a bottom of the container, to provide that the groove extends as far as the bottom of the container so as to form a reinforcing rib for said container bottom, with the rear wall of the groove then having a curvature with its concavity being directed outwards.

BRIEF DESCRIPTION OF THE DRAWINGS

A clearer understanding of the invention will be gained from reading the following detailed description of certain preferred embodiments presented purely as examples, without implying any limitation. In this description, reference is made to the appended drawings, in which.

DETAILED DESCRIPTION OF THE INVENTION

Figure 1:
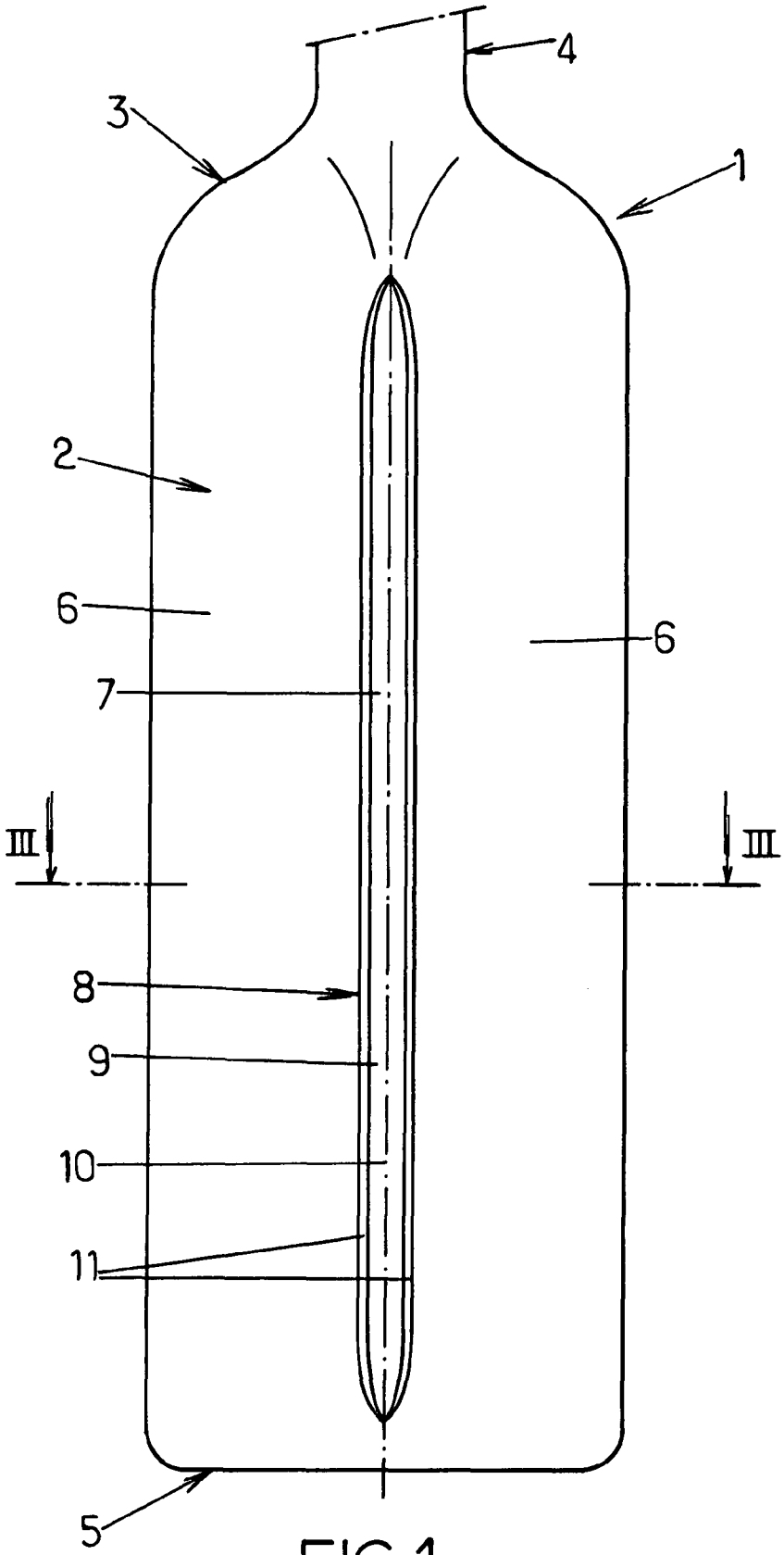
- FIG. 1 is a side view of a container provided with a body being substantially prismatic in shape with a substantially triangular cross section, arranged in accordance with the invention.
Figure 3:
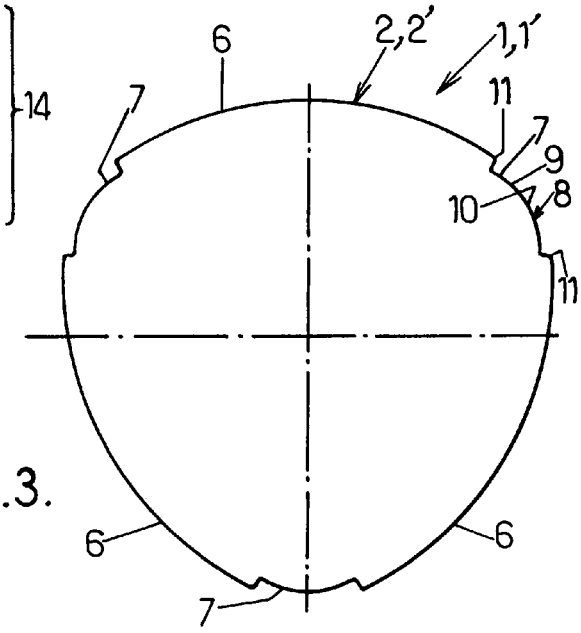
- FIG. 3 is a highly schematic view in cross section on the line III-III in FIG. 1 and in FIG. 2.

The features according to the invention will now be explained with reference initially to FIGS. 1 and 3. In FIG. 1 is shown in a side view a container 1 such as a bottle, made of a thermoplastic material, especially PET. The container 1 comprises a body 2 joined up, via a shoulder 3, to a neck 4 and below to a bottom 5 which may have any shape appropriate to the use of the container. For approximately its entire height, the body 2 is substantially prismatic in shape, with a substantially triangular cross section, as can be seen in FIG. 3; in other words the body 2 has three faces 6 joined to each other by three edges 7; in the example shown, the three faces 6 are rounded with a convexity directed outwards.

According to the invention, each edge 7 has a complex structure and is shaped in the form of a groove 8 which is open outwards and whose rear wall 9 has a reversed curvature with a convexity directed outwards. In the preferred embodiment shown in FIG. 3, it is provided that the apex 10 of the convexity of the rear wall 9 of the groove 8 is positioned substantially level with the sides 11 of the groove 8 so as to minimize discontinuities in the outer surface of the body 2.

Therefore, each edge 7 is shaped in cross section very approximately like a W with a rounded central part, forming a sort of bellows with an excellent elastic deformability, particularly when the walls 6 are subjected to radial forces which would change the shape thereof.

The advantages conferred by edges arranged in accordance with the invention are not limited to just the case of a body with grooves running its entire height as shown in FIG. 1 as an example, and any part of the body which is substantially prismatic in shape with an substantially triangular cross section can, independently of the configuration of the rest of the body of the container, be constructed in accordance with the invention.

Figure 2:
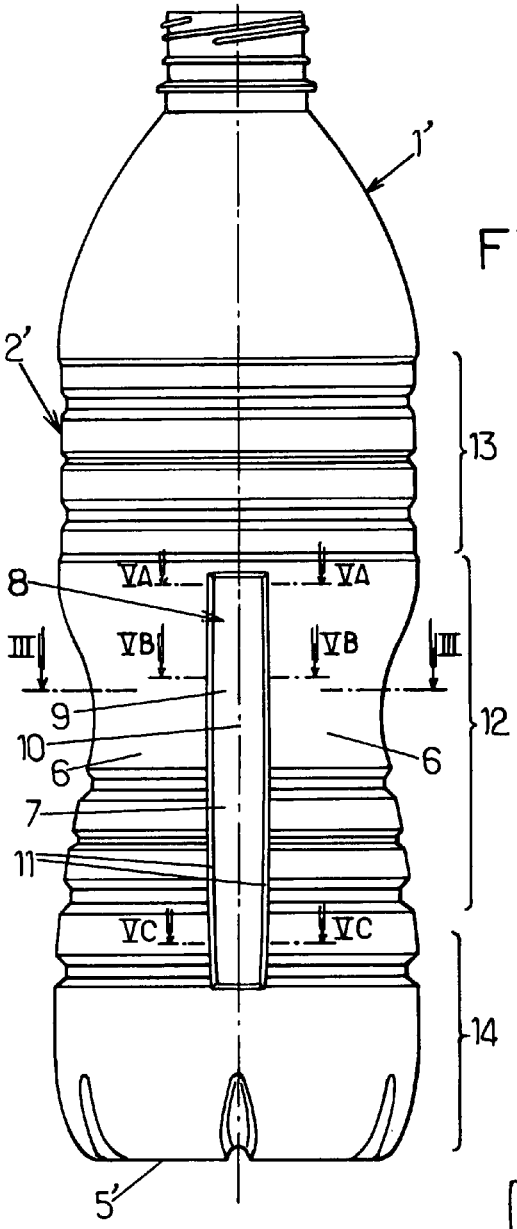
- FIG. 2 is a side view of a container in which only the middle part of the body is substantially prismatic with a substantially triangular cross section and arranged in accordance with the invention.

So, in FIG. 2 a container 1 of the bottle type is illustrated, in which the body 2' has a complicated shape: the body 2' is substantially prismatic in shape only in its middle part 12, which is flanked by an upper part 13 and a lower part 14, both being substantially cylinders of revolution (possibly with reinforcing channels of any appropriate shape) and having transverse dimensions substantially greater than the transverse dimension of said middle part 12. The cross section shown in FIG. 3 is taken through said middle part 12; FIG. 5B shows part of the same cross section.

Being so arranged, the middle part 12 is a handgrip portion which not only helps in gripping the container because of its reduced transverse dimensions, but sits very well in the hand because of its approximately triangular shape.

Figure 5A:
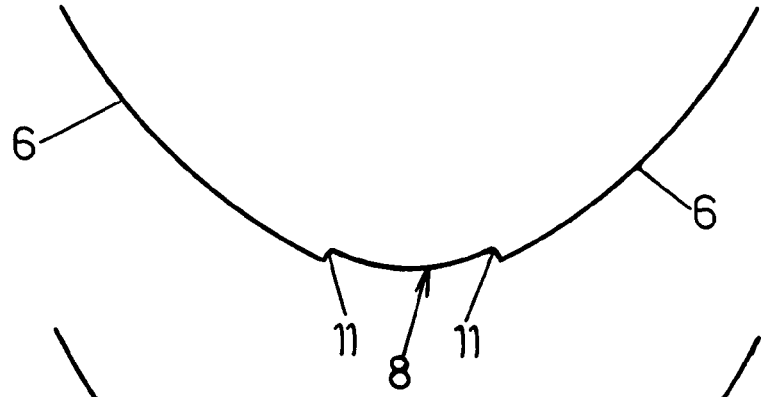
- FIGS. 5A to 5D are partial schematic sections through the bodies of the containers shown in FIGS. 2 and 4A at various locations.
Figure 5B:
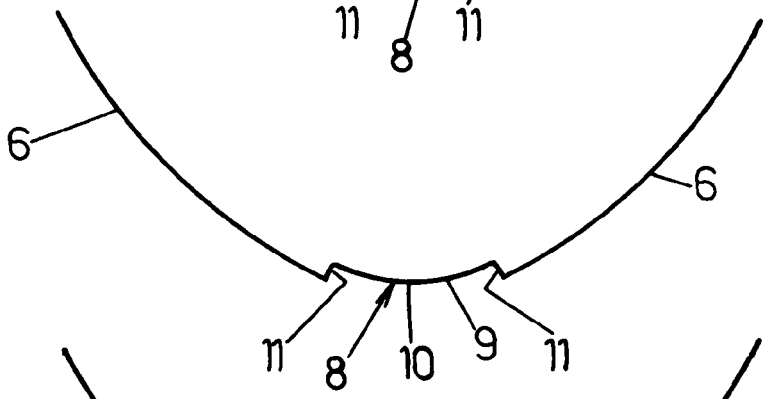

In this context, it can be provided that each groove 8 extends as far as the join of the middle part 12 and the upper part 13 of the body 2'; then it can be provided that near this join the depth of the groove 8 decreases gradually; in this region the rear wall 9 of the groove 8 may have any appropriate shape, for example to be substantially flat or, in a preferred embodiment, to merge approximately with the shape of the upper part 13 (FIG. 5A, the sides 11 of the groove continue to be marked distinctly to ensure the visual continuity on aesthetic grounds).

Figure 5C:
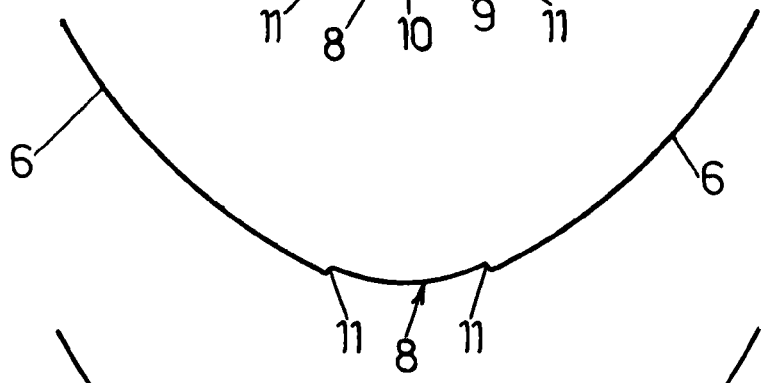

It can also be provided that each groove 8 extends as far as the join of the middle part 12 and the lower part 14 of the body 2'; then it can be provided that near this join the depth of the groove 8 decreases gradually; in this region the rear wall 9 of the groove 8 may have any appropriate shape, for example to be substantially flat or, in a preferred embodiment, to merge approximately with the shape of the lower part 14 (FIG. 5C); in addition, as shown in FIG. 3, it can be provided that each groove 8 extends partially into the lower part 14 of the body 2' and that the rear wall 9 of the groove 8 merges with the shape of the lower part 14.

Figure 4A:
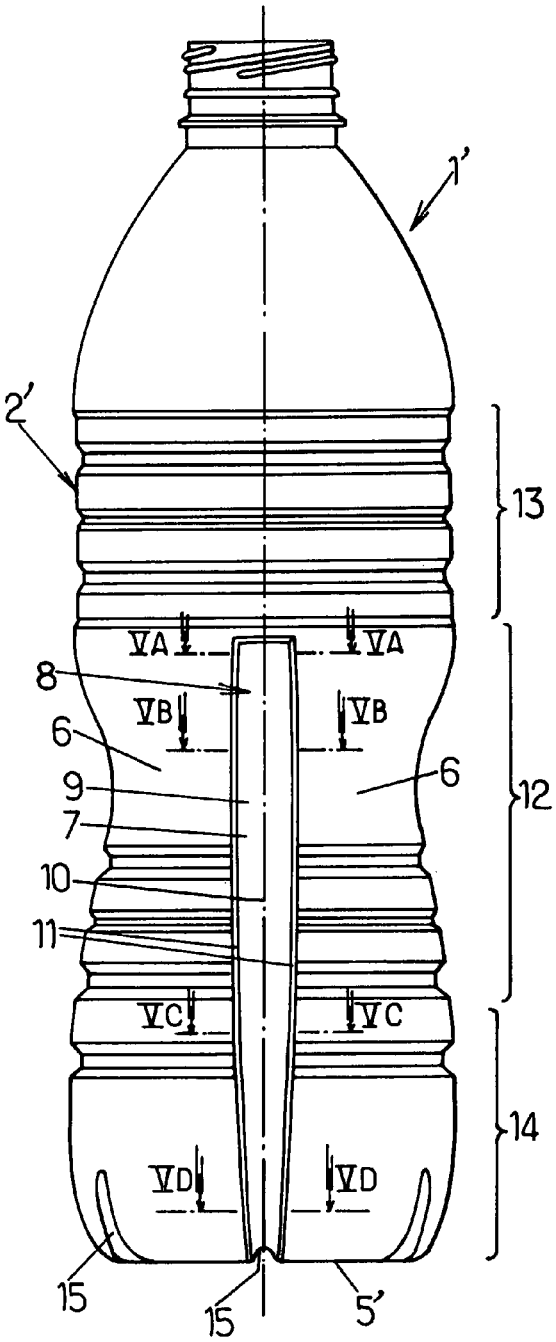
- FIG. 4A is a side view of an advantageous alternative embodiment of the container shown in FIG. 2.
Figure 5D:
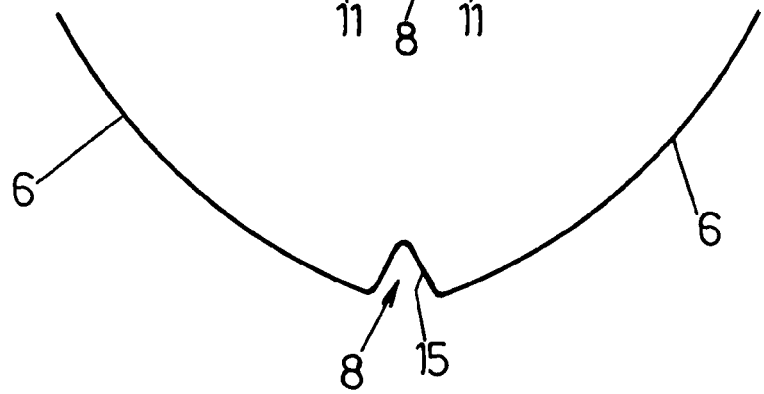

A useful alternative embodiment may relate to a container 1', such as a bottle, as shown in FIG. 4A, in which the base 5' of the container, located at the base of the lower part 14, has reinforcing ribs 15 which partially rise up the sides of said bottom 5' of the container. In this case, with the body 2' of the container being constructed in other respects as described above with reference to FIG. 2, it may be helpful to have the groove 8 extending as far as the bottom 5' of the container 1' so as to form one of the ribs 15 of said bottom 5' of the container. In this case, the rear wall 9 of the groove 8 has a reversed curvature, with a concavity directed outwards (FIG. 5D).

Figure 4B:
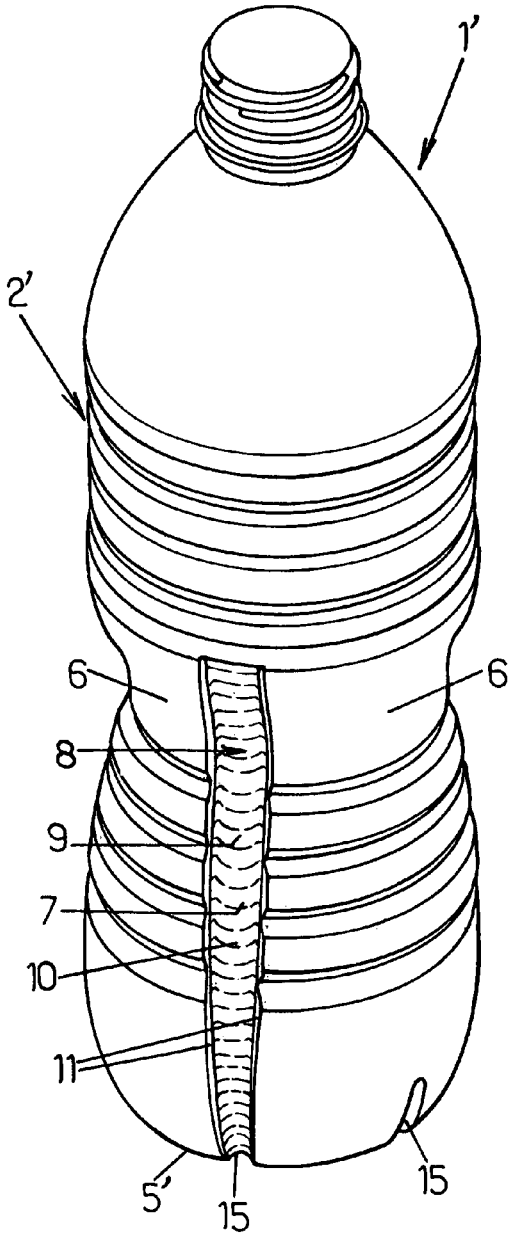
- FIG. 4B is a perspective view from above the container of FIG. 4A, allowing a better view of the precise shaping of a groove all the way down.

In FIG. 4B which shows the container 1' of FIG. 4A in perspective from above, the development of the shape of the rear wall 9 of the groove 8 can be clearer viewed, with the reversal of the curvature from the middle part 12 to the lower part 14 where the groove 8 begins to form a rib 15.

It would be seen too that the groove 8 can be of variable width; in particular, as visible in FIG. 4A, the groove 8 maintains an approximately constant width in the middle part 12 of the body 2' of the container, but the width thereof narrows down in the lower part 14 of the body 2' until becoming the width of a rib 15.

It should be observed, too, that the design of the edges constructed in accordance with the invention leads to a structure without projections, of very unfussy lines and which does not detract from the aesthetic appearance of the container.

What is claimed is:

1. A container made of a thermoplastic material having a body which, for at least a part of its height, is substantially prismatic in shape with a substantially triangular cross section and with three faces joined by three edges, wherein each of said edges is shaped in the form of a groove which opens outwards and which has a rear wall having a reversed curvature with its convexity directed outwards.

2. The container according to claim 1, wherein apex of said convexity of said rear wall of said groove is substantially level with the edges of said groove.

3. The container according to claim 1, wherein said body is substantially prismatic in shape in its middle part only, which lies between an upper part and a lower part that are both substantially cylinders of revolution and have transverse dimensions substantially greater than the transverse dimension of said middle part.

4. The container according to claim 3, wherein each groove extends as far as the join between said middle and upper parts of said body and wherein in the region of this join the depth of said groove gradually decreases so that said rear wall of said groove merges approximately into the shape of said upper part.

5. The container according to claim 3, wherein each groove extends as far as the join between said middle and lower parts of said body and wherein in the region of this join the depth of said groove gradually decreases so that said rear wall of said groove merges approximately into the shape of said lower part.

6. The container according to claim 3, wherein each groove extends as far as the join between said middle and lower parts of said body, wherein in the region of this join the depth of said groove gradually decreases so that said rear wall of said groove merges approximately into the shape of said lower part, and wherein each groove extends into said lower part of said body, with said rear wall of said groove merging into the shape of said lower part.

7. The container according to claim 3, in which said lower part of said body meets a bottom of said container, wherein each groove extends as far as the join between said middle and lower parts of said body, wherein in the region of this join the depth of said groove gradually decreases so that said rear wall of said groove merges approximately into the shape of said lower part, wherein each groove extends into said lower part of said body, with said rear wall of said groove merging into the shape of said lower part, and wherein said groove extends as far as said bottom of said container so as to form a reinforcing rib for said container bottom, with said rear wall of groove then having a reversed curvature with its concavity being directed outwards.

8. The container according to claim 1, wherein the thermoplastic material is PET.

9. The container according to claim 1, wherein each edge is configured so that the edge elastically deforms when the faces of the body are subjected to a force acting radially towards the interior.

10. The container according to claim 1, wherein each edge is configured so that the edge pivots, open outs and flattens elastically when the faces of the body are subjected to a force acting radially towards the interior.

11. The container according to claim 1, wherein each side end of each groove adjoins an end of a corresponding one of the faces.

12. The container according to claim 1, wherein each groove is delimited in a circumferential direction of the container by two of the faces such that at least portions of each groove near where the groove adjoins the two faces are disposed radially inward of two faces.

* * * * *